US006209156B1

(12) United States Patent
Hershey

(10) Patent No.: US 6,209,156 B1
(45) Date of Patent: Apr. 3, 2001

(54) PILLOW CASE PAD

(76) Inventor: Sally A. Hershey, 111 Washington St., Harrisburg, PA (US) 17104

( * ) Notice: Subject to any disclaimer, the term of this patent is extended or adjusted under 35 U.S.C. 154(b) by 0 days.

(21) Appl. No.: 09/534,654

(22) Filed: Mar. 24, 2000

(51) Int. Cl.[7] ..... A47G 9/02
(52) U.S. Cl. ..... 5/490; 5/487; 5/502
(58) Field of Search ..... 5/484, 485, 486, 5/487, 490, 502

(56) References Cited

U.S. PATENT DOCUMENTS 1,275,205 * 8/1918 Bigham et al. ..... 5/490
3,761,973 * 10/1973 Leventhal ..... 5/487 X
4,253,701 * 3/1981 Klfferstein ..... 5/487 X
5,991,945 * 11/1999 Pang ..... 5/490

* cited by examiner

*Primary Examiner*—Michael F. Trettel
(74) *Attorney, Agent, or Firm*—John J. Elnitski, Jr.

(57) ABSTRACT

The present invention is a pillow case pad having a plurality of disposable pillow sheets to receive a pillow. The disposable pillow sheets attached together to form the pillow case pad. Each disposable pillow sheet being attached such that a top sheet can be removed and disposed of after use. Each of the disposable pillow sheets include a front face and a rear face attached together to form a pocket for the pillow, whereby the front face faces outward from the pillow case pad and the rear face lays against the next disposable pillow sheet below. Each of the disposable pillow sheets include a flapped opening to receive the pillow into a pocket.

17 Claims, 7 Drawing Sheets

PILLOW CASE PAD

BACKGROUND

A pillow case is a covering to encase a pillow to prevent soiling of the pillow. Pillow cases are widely used in the medical field due the large use of pillows to comfort patients. One type of pillow case that is being used currently is of a disposable variety. Current disposable pillow cases are usually made using a paper material and find wide use in examining rooms. These disposable pillow cases are disposed of immediately after each patient use and replaced with a new pillow case for the next patient. This type of use in examining rooms requires additional space in each room to store the disposable pillow cases. There is also a time factor, whereby the staff of a medical facility must find the disposable pillow cases, remove one and move it to the examining table or chair and then place a pillow in it.

It is an object of the present invention to provide disposable pillow cases with removable sheets that can be stored with the pillow on the examining table or chair in a convenient manner to reduce storage space needed and the time factor involved in changing a pillow case.

SUMMARY OF THE INVENTION

The present invention is a pillow case pad having a plurality of disposable pillow sheets to receive a pillow. The disposable pillow sheets attached together to form the pillow case pad. Each disposable pillow sheet being attached such that a top sheet can be removed and disposed of after use. Each of the disposable pillow sheets include a front face and a rear face attached together to form a pocket for the pillow, whereby the front face faces outward from the pillow case pad and the rear face lays against the next disposable pillow sheet below. Each of the disposable pillow sheets include a flapped opening to receive the pillow into a pocket.

DETAILED DESCRIPTION

Figure 1:
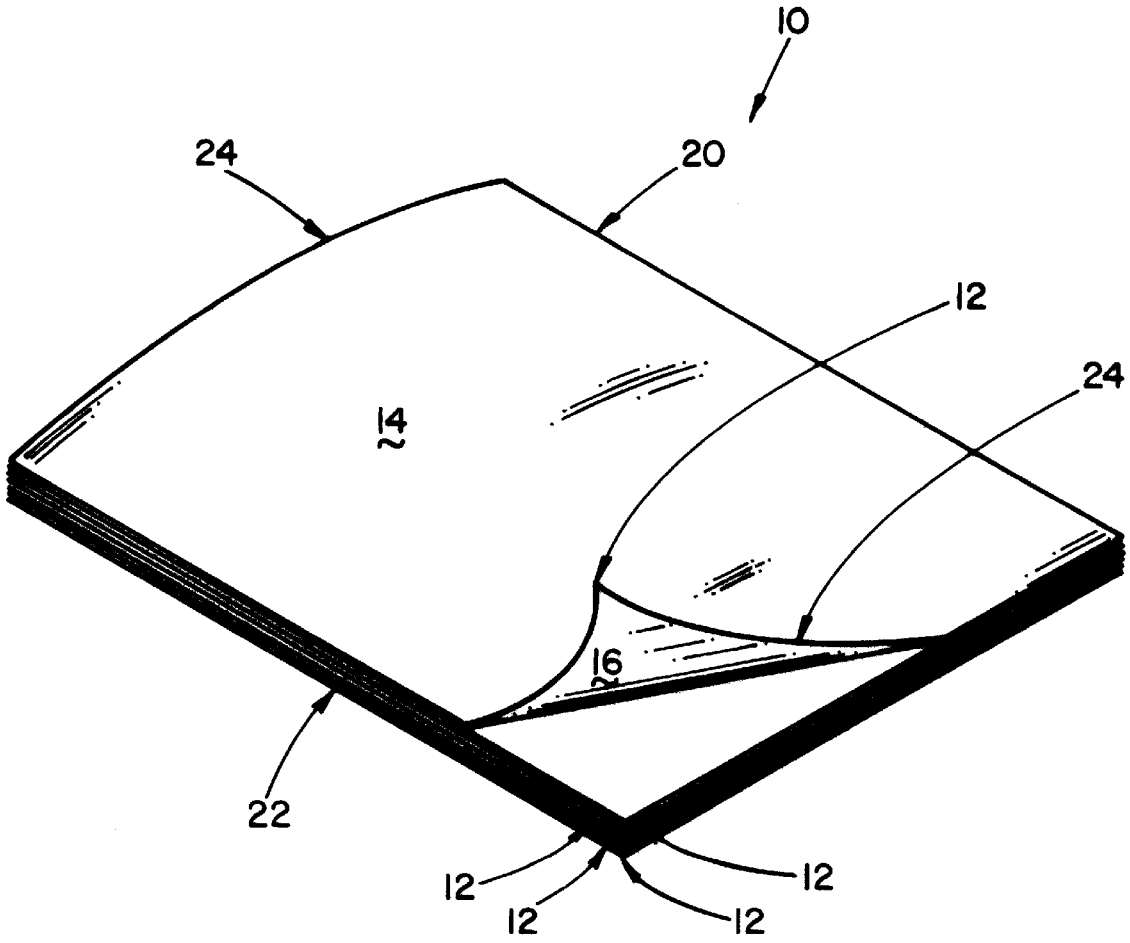
FIG. 1 is a perspective top view of a pillow case pad according to the present invention.
Figure 2:
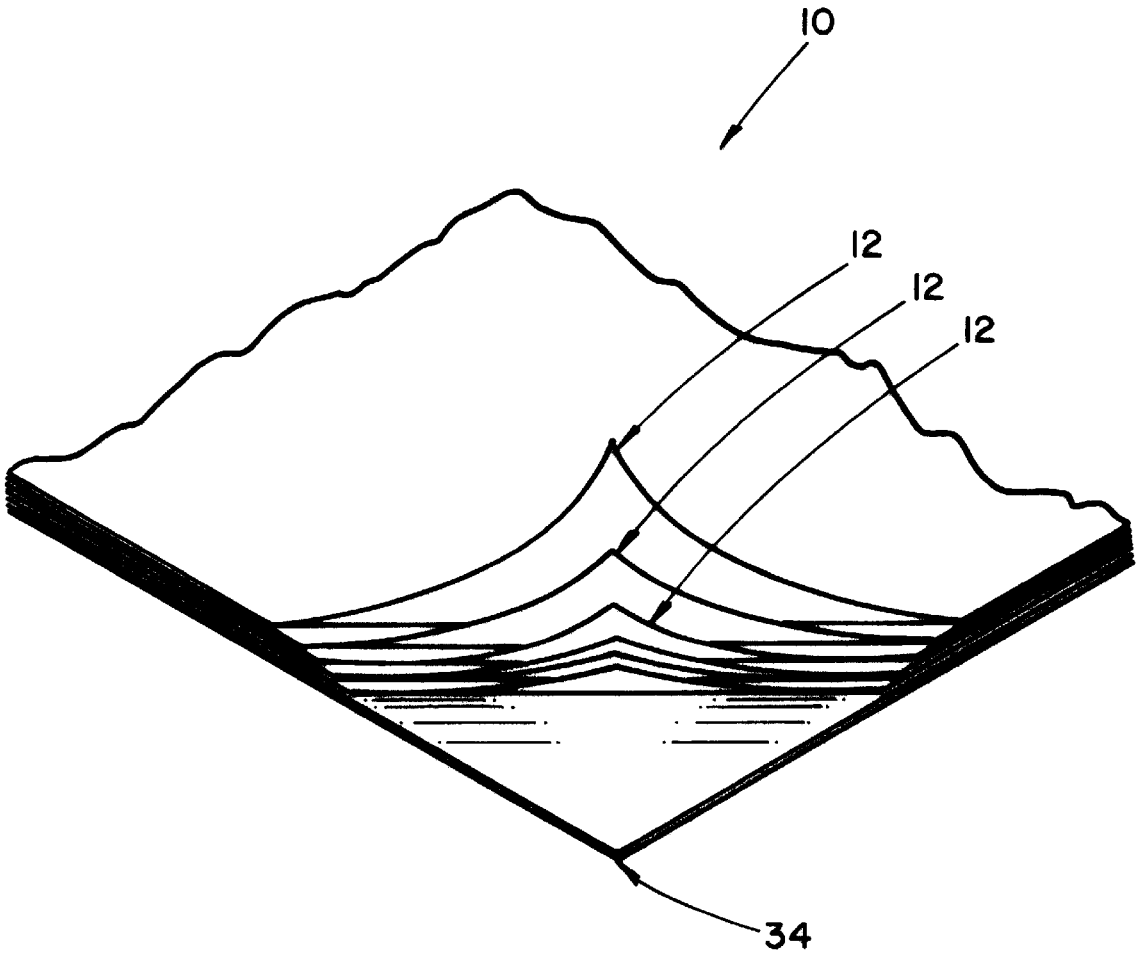
FIG. 2 is a perspective top view of a pillow case pad according to the present invention.
Figure 8:
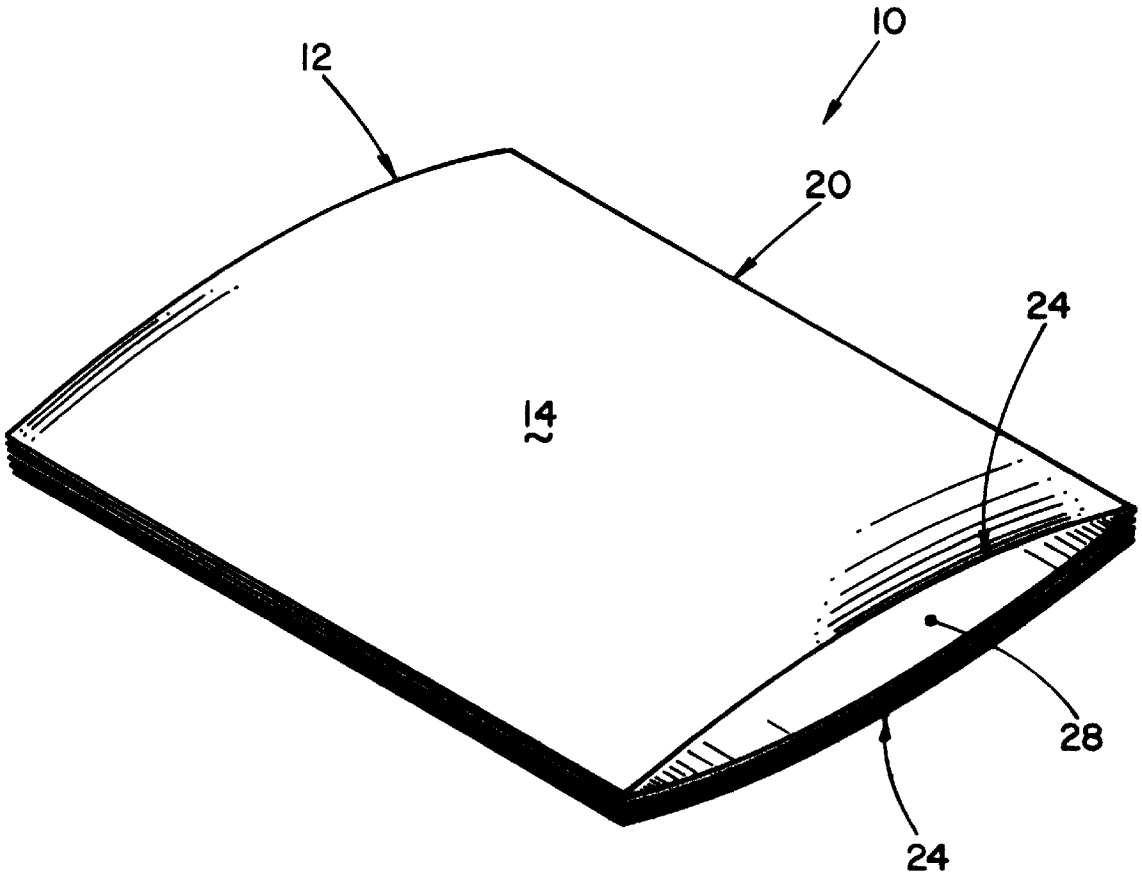
FIG. 8 is an perspective top view of a pillow case pad according to the present invention.

The present invention is a pillow case pad 10 which provides a plurality of detachable disposable pillow sheets 12 as shown in FIGS. 1–2. The pillow case pad 10 includes individually attached disposable pillow sheets 12. Each disposable pillow sheet 12 is shown having a front face 14 and rear face 16, whereby each face has four sides. Each disposable pillow sheet 12 is shown having the sides of the front and rear faces 14, 16 attached together to form four edges including a top 20, bottom 22 and two sides 24. The rear face 16 is shown in FIGS. 3–6 with a flapped opening 26. The attachment of the front and rear faces 14, 16 forms a pocket 28 to hold a pillow 30. Access to insert the pillow 30 in the pocket 28 is provided by the flapped opening 26 of the rear face 16. It is possible to make each disposable pillow sheet 12 from one sheet of material, whereby the top 20, bottom 22 and sides 24 are formed by folding the material used. Also, the flapped opening 26 can be replaced by having one of either the top 20, bottom 22 or sides 24 unattached as shown in FIG. 8 to provide access to insert the pillow 30.

Figure 3:
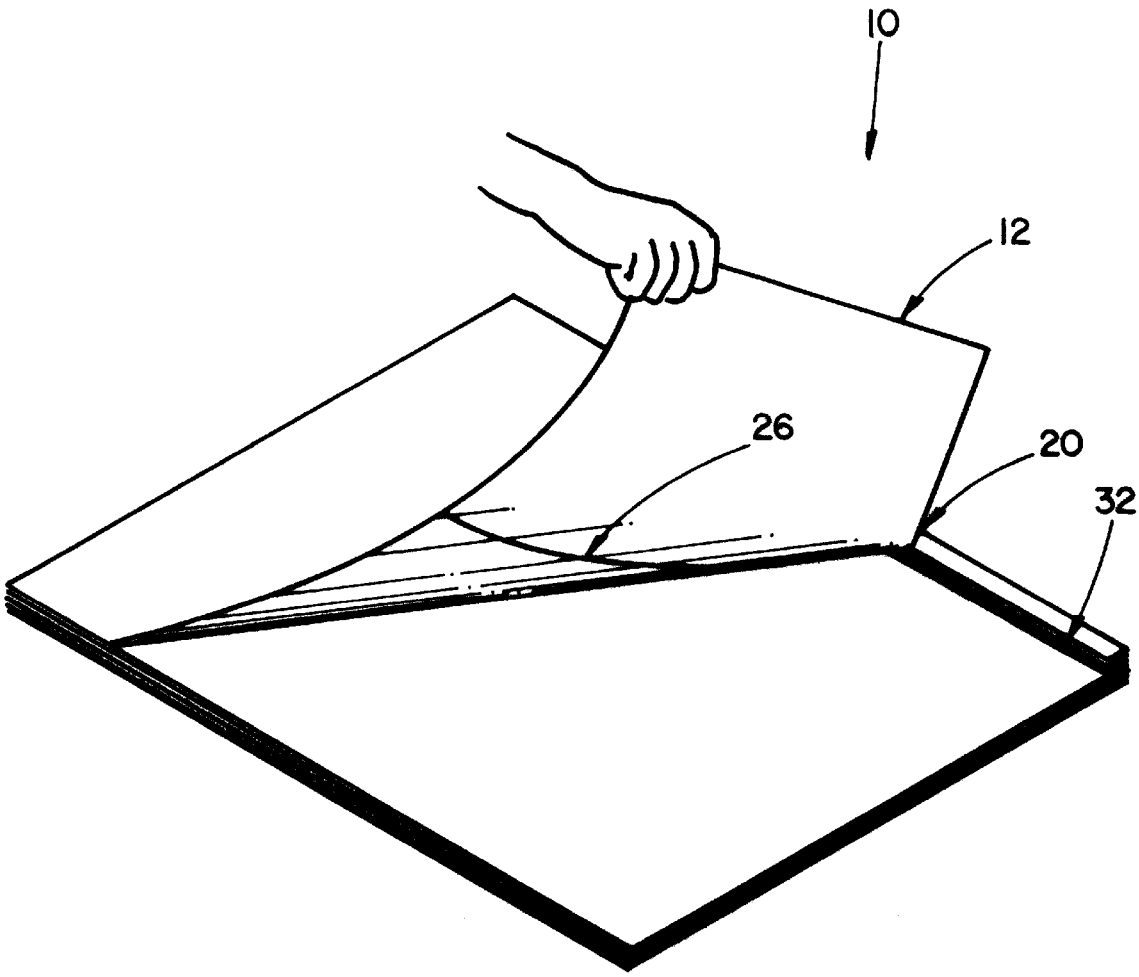
FIG. 3 is a perspective top view of a pillow case pad according to the present invention.
Figure 9:
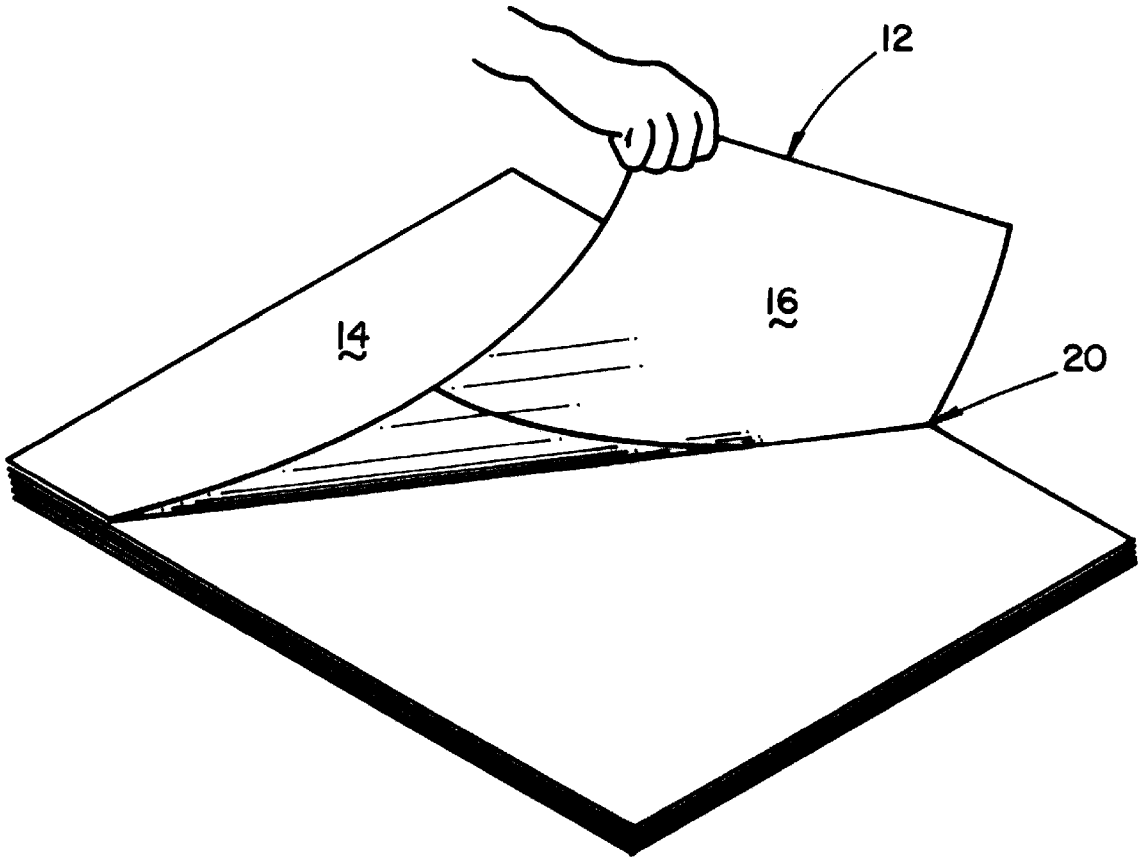
FIG. 9 is an perspective top view of a pillow case pad according to the present invention.

The disposable pillow sheets 12 are attached together at one of either the top 20, bottom 22, or sides 24 which is bound to form the pillow case pad 10. FIGS. 3 and 9 show the disposable pillow sheets 12 attached together at the top 20, whereby the front face 14 of each disposable pillow sheet 12 faces outward from the pillow case pad 10. The binding of the disposable pillow sheets 12 to form the pillow case pad 10 can be done using known techniques for binding materials into bound pads or books. The binding of the disposable pillow sheets 12 can range from sewing to gluing them together. Two examples are shown in FIGS. 3 and 9. The example shown in FIG. 9 shows the top 20 of each disposable pillow sheet 12 bound together such that they can be torn off from each other. The example shown in FIG. 3 shows each disposable pillow sheet 12 attached a binding, whereby each disposable pillow sheet 12 is torn away along a perforation 32.

The materials to make the pillow sheet 12 can be of a variety of know materials for making disposable items such as cloth or paper. It is envisioned that a 2 ply quilted paper with a plastic backing such as those used for dental bibs would be an appropriate choice. Whereby the plastic backing would form the inside of each disposable pillow sheet 12 to protect the pillow 30. The disposable pillow pad 10 can include a cardboard bottom 34 or the like to provide support for the disposable pillow pad 10 to ease handling of the disposable pillow pad 10, as shown in FIG. 2.

Figure 5:
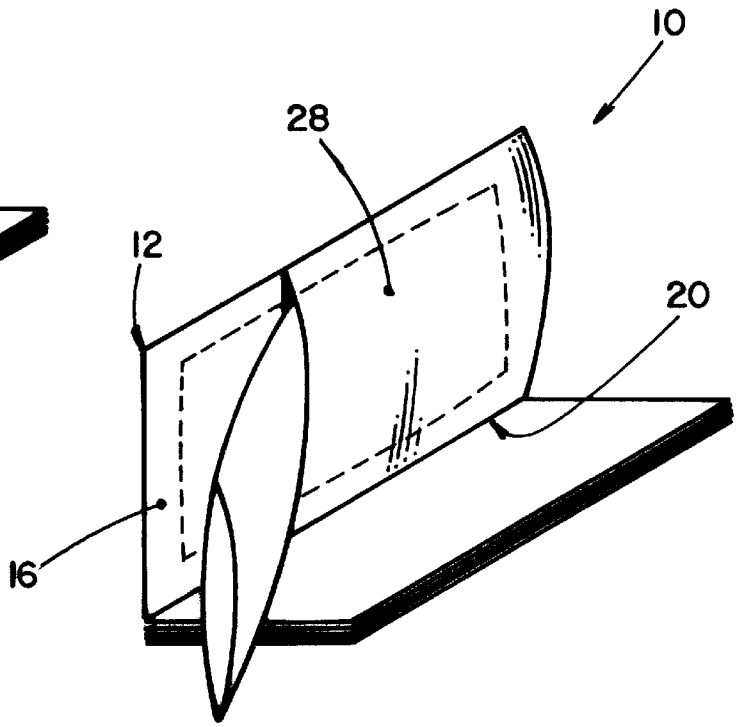
FIG. 5 is an exploded perspective top view of a pillow case pad according to the present invention.
Figure 4:
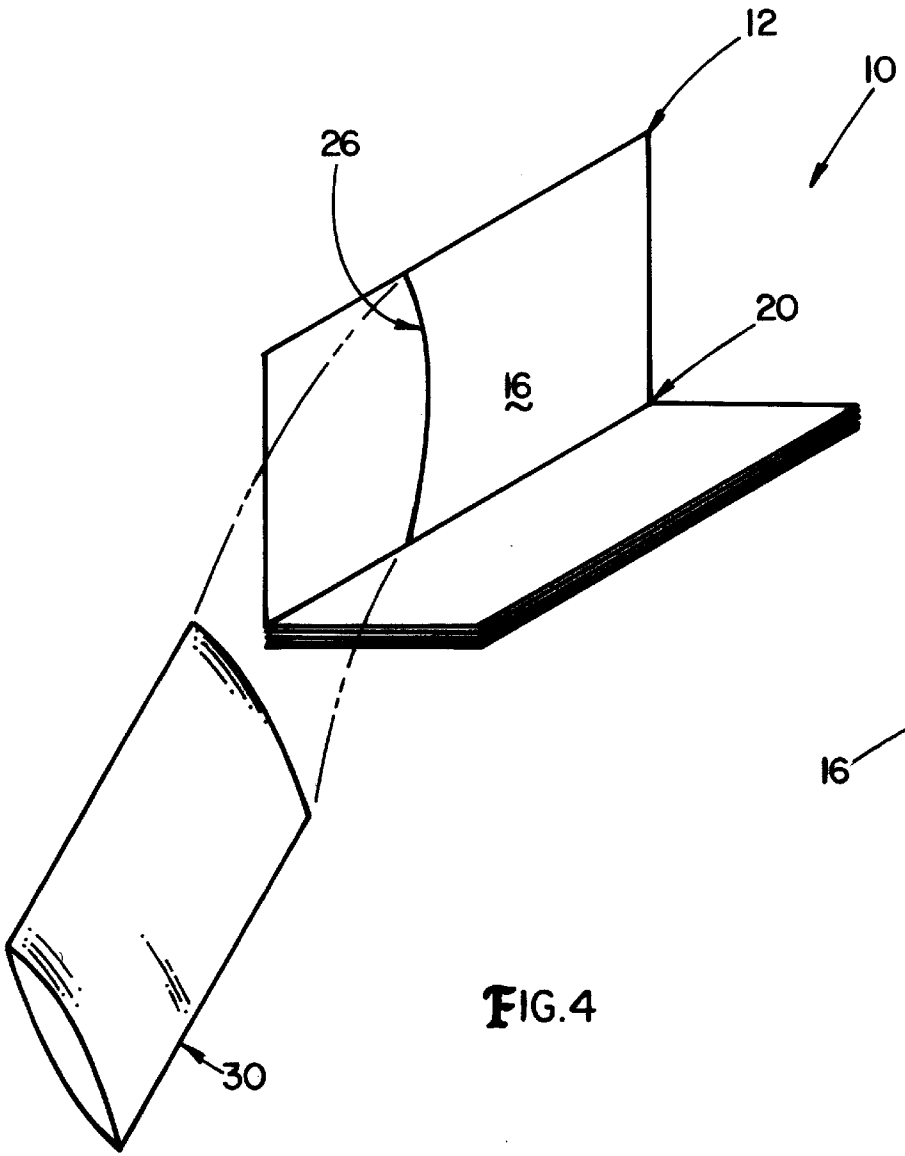
FIG. 4 is an exploded perspective top view of a pillow case pad according to the present invention.
Figure 7:
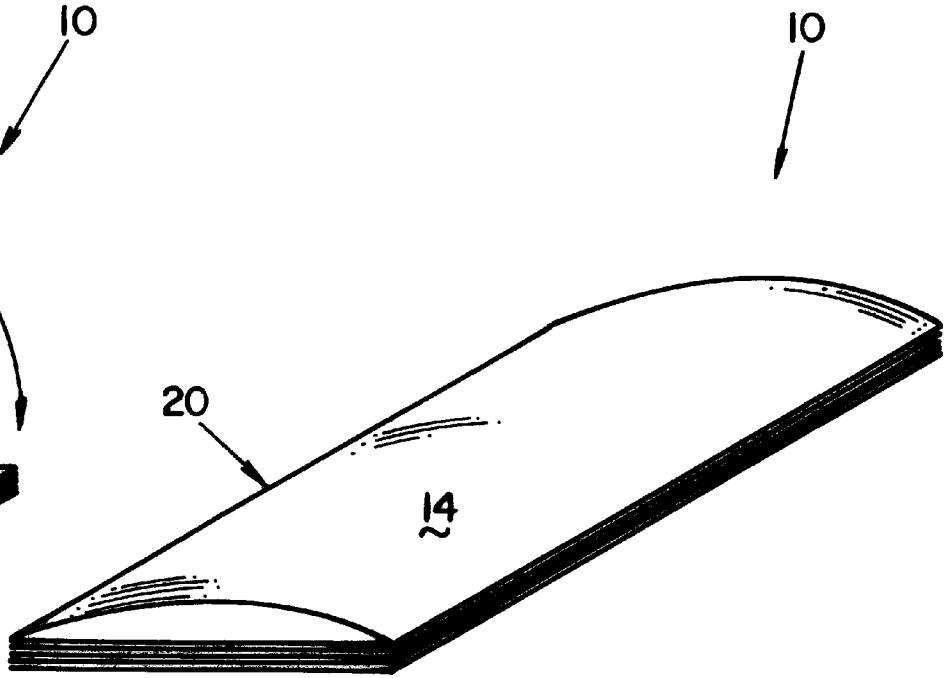
FIG. 7 is an perspective top view of a pillow case pad according to the present invention.
Figure 6:
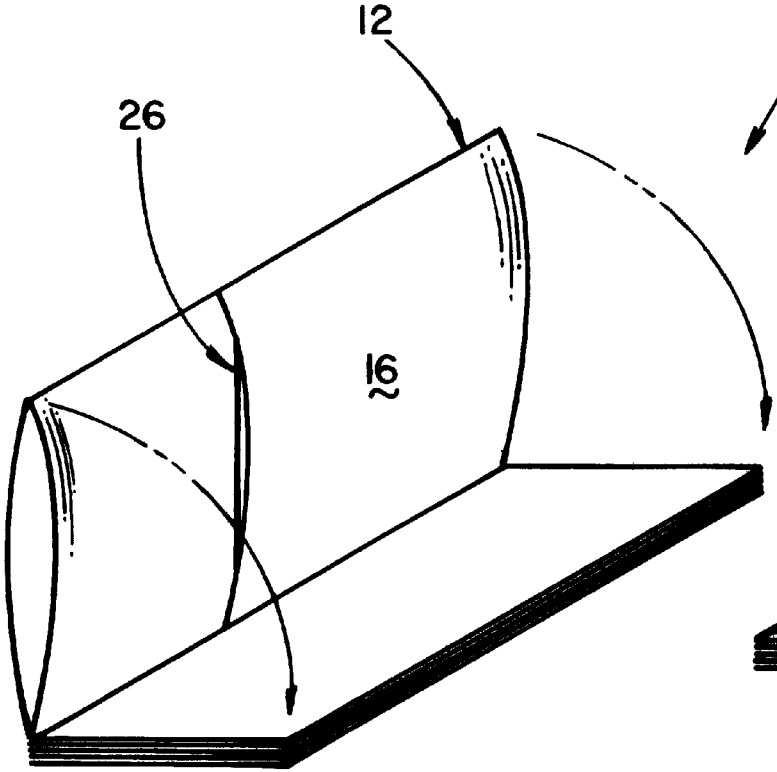
FIG. 6 is an exploded perspective top view of a pillow case pad according to the present invention.

FIGS. 3–7 and 9 show the use of the pillow case pad 10. FIG. 4 shows one of the disposable pillow sheets 12 is lifted up from the pillow case pad 10 and the flapped opening 26 in an opened position to insert the pillow 30. FIG. 5 shows the pillow 30 being inserted into one of the disposable pillow sheets 12. FIG. 6 shows the pillow 30 fully inserted into one of the disposable pillow sheets 12 and the disposable pillow sheet 12 being rotated down onto the pillow case pad 10. FIG. 7 shows the pillow case pad 10 with a pillow 30 that is ready for use by a patient. FIGS. 3 and 9 show how a used disposable pillow sheet 12 is then removed from the pillow case pad 10, once used by a patient.

Another embodiment envisioned is where only a bottom sheet of the plurality of detachable disposable pillow sheets 12 of the pillow case pad 10 includes the flapped opening 26 or other type of access to insert the pillow 30, such as an open end of the sheet. All of the sheets 12 above the bottom sheet would not need to contain the pillow 30, but would cover the bottom sheet. The sheets 12 above the bottom sheet could be made from one piece of material, as they would not be used to form a pocket for the pillow 30. The bottom sheet could be made from a more sturdy material. This embodiment would be used by placing the pillow 30 in the bottom sheet, whereby the sheets 12 above would lay on the bottom sheet containing the pillow 30. A patient's head would be laid on the top sheet 12, whereby that top sheet 12 would be torn off and disposed of after the patient's use and the next top sheet 12 would be ready for the next patient.

While embodiments of the invention have been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention which is to be given the full breadth of any and all equivalents thereof.

I claim:

1. A pillow case pad comprising, a plurality of disposable pillow sheets to receive a pillow, each of said disposable pillow sheets including a front face and rear face attached together to encase a pillow, said disposable pillow sheets attached together to form said pillow case pad and each disposable pillow sheet being attached such that each of said disposable pillow sheets can be removed and disposed of after use.

2. The pillow case pad of claim 1, wherein each of said disposable pillow sheets include a flapped opening to receive the pillow into a pocket.

3. The pillow case pad of claim 1, wherein each of said disposable pillow sheets include a flapped opening on said rear face to receive the pillow into said pocket.

4. The pillow case pad of claim 1, wherein each of said disposable pillow sheets include an open side between said front and rear faces to receive the pillow into said pocket.

5. The pillow case pad of claim 1, wherein said disposable pillow sheets are attached together at an edge by gluing, such that each of said disposable pillow sheets can be torn off individually.

6. The pillow case pad of claim 1, wherein said disposable pillow sheets are attached together at an edge by sewing, such that each of said disposable pillow sheets can be torn off individually.

7. The pillow case pad of claim 1, wherein each of said disposable pillow sheets are attached to a perforated binding at an edge, such that each of said disposable pillow sheets can be torn off individually at said perforation.

8. The pillow case pad of claim 1, wherein said disposable pillow sheets are made of paper.

9. The pillow case pad of claim 8, wherein each of said disposable pillow sheets have an inside backing coated with plastic.

10. The pillow case pad of claim 1, further including a bottom to support said pillow case pad.

11. A pillow case pad comprising, a bottom sheet to receive a pillow, said bottom sheet including a front face and rear face attached together to encase a pillow, a plurality of disposable sheets on top of said bottom sheet to protect said bottom sheet, said disposable sheets and said bottom sheet attached together to form said pillow case pad and each disposable sheet being attached such that each of said disposable sheets can be removed and disposed of after use.

12. The pillow case pad of claim 11, wherein said bottom sheet includes a flapped opening to receive the pillow into a pocket.

13. The pillow case pad of claim 11, wherein said bottom sheet includes a flapped opening on said rear face to receive the pillow into said pocket.

14. The pillow case pad of claim 11, wherein said bottom sheet includes an open side between said front and rear faces to receive the pillow into said pocket.

15. The pillow case pad of claim 11, wherein said disposable sheets are attached together at an edge by gluing, such that each of said disposable sheets can be torn off individually.

16. The pillow case pad of claim 11, wherein said disposable sheets are attached together at an edge by sewing, such that each of said disposable sheets can be torn off individually.

17. The pillow case pad of claim 11, wherein each of said disposable sheets are attached to a perforated binding at an edge, such that each of said disposable sheets can be torn off individually at said perforation.

* * * * *